US006209379B1

(12) United States Patent
Nishida et al.

(10) Patent No.: US 6,209,379 B1
(45) Date of Patent: Apr. 3, 2001

(54) LARGE DEFORMATION APPARATUS, THE DEFORMATION METHOD AND THE DEFORMED METALLIC MATERIALS

(75) Inventors: Yoshinori Nishida; Shoichi Kume; Tsunemichi Imai, all of Aichi (JP)

(73) Assignee: Agency of Industrial Science and Technology, Tokyo (JP)

( * ) Notice: Subject to any disclaimer, the term of this patent is extended or adjusted under 35 U.S.C. 154(b) by 0 days.

(21) Appl. No.: 09/514,292

(22) Filed: Feb. 28, 2000

(30) Foreign Application Priority Data

Apr. 9, 1999 (JP) ..... 11-101956

(51) Int. Cl.[7] ..... B21C 27/00

(52) U.S. Cl. ..... 72/272; 72/253.1; 72/358; 72/377

(58) Field of Search ..... 72/253.1, 272, 72/259, 261, 273, 273.5, 355.2, 355.4, 355.6, 358, 359, 377

(56) References Cited

U.S. PATENT DOCUMENTS

| | | | | |
|---|---|---|---|---|
| 3,158,262 | * | 11/1964 | Scribner | 72/259 |
| 4,580,432 | * | 4/1986 | Breazeale et al. | 72/355.6 |
| 5,400,633 | * | 3/1995 | Segal et al. | 72/253.1 |
| 5,600,989 | * | 2/1997 | Segal et al. | 72/253.1 |

FOREIGN PATENT DOCUMENTS

| | | | | |
|---|---|---|---|---|
| 3-193207 | * | 8/1991 | (JP) | 72/272 |
| 940987 | * | 7/1982 | (SU) | 72/259 |

OTHER PUBLICATIONS

Zenji Horita, et al. "Equal–Channel Angular Pressing (ECAP): A Novel Method for Microstructural Control," Materia Japan, vol. 37, No. 9, 1998, pp. 767–774.

H. Fujita, et al., Kinzoku, vol. 65, No. 12, 1995, pp. 1143–1154.

T. Aizawa, et al. Kinzoku, vol. 65, No. 12, 1995, pp. 1155–1161.

S. L. Semiatin, et al. "Workability of a Gamma Titanium Aluminide Alloy During Equal Channel Angular Extrusion," Scripta Metallurgica et Materialia, vol. 33, No. 4, 1995, pp. 535–540.

V. M. Segal, et al. "In Situ Composites Processed by Simple Shear," Materials Science and Engineering, vol. A224, 1997, pp. 107–115.

Yoshinori Iwahashi, et al. "Microstructural Characteristics of Ultrafine–Grained Aluminum Produced Using Equal–Channel Angular Pressing," Metallurgical and Materials Transactions A, vol. 29A, Sep. 1998, pp. 2245–2252.

* cited by examiner

*Primary Examiner*—Ed Tolan
(74) *Attorney, Agent, or Firm*—Oblon, Spivak, McClelland, Maier & Neustadt, P.C.

(57) ABSTRACT

The present invention relates to a large deformation apparatus for metal-based materials that comprises a mold (A), a support mechanism (B) for supporting the mold (A), and a rotary mechanism (C) for rotating the mold (A), wherein the mold (A) comprises a mold body (1), four holes (2) that pass through the mold body (1) and intersect in its interior, and engagement means (3*a*) for engaging the rotary mechanism (C), each hole (2) being provided with a punch (5) that can slide or otherwise move with friction in relation to the hole (2) and that extends from the end face of the mold body (1) to the intersection of the holes (2); the support mechanism (B) comprises restraint plates (6*a*), (6*b*), and (6*c*) for restraining the external end faces of the mold body (1) having holes (2), and holding plates (7*a*) and (7*b*) for holding the mold body (1); and the rotary mechanism (C) comprises engagement means (3*b*) for engaging the engagement means (3*a*), rotary means (8), connection means (9) for connecting the engagement means (3*b*) and the rotary means (8), and to a method for applying large deformation to a metal-based material with the aid of the apparatus, and further to a metal-based material subjected to large deformation by the method.

5 Claims, 8 Drawing Sheets

LARGE DEFORMATION APPARATUS, THE DEFORMATION METHOD AND THE DEFORMED METALLIC MATERIALS

BACKGROUND OF THE INVENTION

1. Field of the Invention

The present invention relates to a large deformation technique for metal-based materials, and more particularly to a large deformation apparatus for reducing the crystal grain size of plastically deformable materials, and preferably metal-based materials and metal-based composite materials, by continuously subjecting the materials to large deformation without removing these materials from the mold; to a deformation method therefor; and to a material which is subjected to such continuous large deformation and in which the crystal particles of the matrix are reduced to a grain size of 10 $\mu$m or less.

2. Description of the Related Art

It is generally well known that reducing the crystal grain size of a polycrystalline material is effective for improving the strength and ductility of this material. In conventional practice, therefore, the crystal grains of plastically deformable materials typified by metal-based materials are destructed and recrystallized to achieve a smaller crystal grain size by performing plastic working based on extrusion or rolling at a high temperature above the recrystallization temperature. The work materials are limited in their post-work shape to a wire-rod shape in the case of extrusion, and to a thin-sheet shape in the case of rolling, and these shape limitations impose restrictions on the post-work applications of these materials.

By contrast, Equal-Channel Angular Pressing (ECPA) is a method in which a work material is subjected to shear deformation at a temperature below the melting point of the material by being passed through a curved hole obtained by curving the middle portion of a through hole at a given angle. In this work method, the material can be subjected to large plastic deformation with minimal changes in the external shape of the material before and after working, making it possible to reduce the size of the crystals constituting the work material. An example of this method is the process described in the report by Horita et al. (Materia Japan, Vol. 37, 767–774 (1998)), particularly one shown in the appended drawings.

As described in detail with reference to the aforementioned drawings, this work method is one in which the work material is passed through a curved hole, but a single passage is insufficient for reducing the size of the crystals constituting the material, so large deformation must be repeated at least several times, and usually ten or more times. In other words, the work material usually must be passed through the curved hole after being heated to the working temperature. Consequently, the work material must be repeatedly taken out of the mold outlet and inserted into the mold inlet after passing through the curved hole, and hence must be heated to the working temperature after being inserted into the mold because the temperature of the work material inevitably decreases when the material is taken out of the mold.

A resulting drawback is that complicated procedures must be performed to control the temperature of the work material and that thermal energy commensurate with the reduction in the temperature of the work material must be provided for each work cycle, resulting in a process that is economically disadvantageous and that is time-consuming and inefficient because of the need to wait for the temperature to reach the working level. In addition, the work material is exposed to the atmosphere, undergoing oxidation (which depends on the composition of the material) and creating a burn hazard for the workers.

An urgent need therefore existed for an apparatus and method that would allow a work material retained inside a mold provided with a curved hole to be continuously subjected to the aforementioned high plastic deformation without being taken out of the mold to repeatedly perform the aforementioned high plastic deformation.

According to another method of applying large deformation, materials are shaped as wire rods or thin pieces by being repeatedly inserted into and taken out of variable-diameter continuous holes in accordance with mechanical alloying techniques (Aizawa et al., Kinzoku (Metal), Vol. 65 (1995), 1155–1161). Since mechanical alloying involves processing powder samples, not only it is different from the large deformation method of the present invention in its nature, but there is a risk that cracks will form on the surface of the material as it moves from a smaller hole to a larger hole, and because only a small amount of processing energy is applied to the unprocessed material, several hundred work cycles (depending on the material) need to be performed, resulting in an extremely time-consuming and inefficient process.

According to another method, a material is subjected to large deformation by being alternately pushed in and drawn in the vertical and horizontal directions (Fujita et al., Kinzoku (Metal), Vol. 65 (1995), 1143–1154), but this method is similar to the above-described Aizawa technique in that it involves performing mechanical alloying. In addition, this method is completely unsuitable for processing bulk materials because it necessitates splitting the work material in two in the axial direction. This method thus cannot be used as a means for solving the above-described problems, and an urgent need for finding such a means still remains.

Studies have been conducted concerning the extent of large deformation in work materials during their ECPA processing in holes having bending angles of about 120 degrees and 90 degrees, and it was found that an angle of 90 degrees provides greater deformation.

With the foregoing in view and as a result of repeated and painstaking research conducted with consideration for the above-described prior art and aimed at developing a method for applying large deformation and continuously working a material in a mold without taking this material out of the mold, the inventors perfected the present invention upon discovering that using an apparatus configured as described below allows large deformation to be continuously applied to a material without reintroducing the material into the mold.

An object of the present invention is to provide a large deformation apparatus for a metal-based material that allows materials subjected to large deformation to be continuously subjected to large deformation inside a mold without being taken out of the mold; to provide a work method therefor; and to provide a material whose crystal grains can be reduced in size by the application of such large deformation.

SUMMARY OF THE INVENTION

The present invention provides a large deformation apparatus, a large deformation method, and a metal-based large deformation material.

The present invention relates to a large deformation apparatus for metal-based materials that comprises a mold A, a support mechanism B for supporting the mold A, and a rotary mechanism C for rotating the mold A. The mold A comprises a mold body 1, four holes 2 that pass through the mold body 1 and intersect in its interior, and engagement means 3*a* for engaging the rotary mechanism C. Each hole 2 is provided with a punch 5 that can slide or otherwise move with friction in relation to the hole 2 and that extends from the end face of the mold body 1 to the intersection of the holes 2. The support mechanism B comprises restraint plates 6*a*, 6*b*, and 6*c* for restraining the external end faces of the mold body 1 having holes 2, and holding plates 7*a* and 7*b* for holding the mold body 1. The rotary mechanism C comprises engagement means 3*b* for engaging the engagement means 3*a*, rotary means 8, connection means 9 for connecting the engagement means 3*b* and the rotary means 8. The invention also relates to a method for applying large deformation to a metal-based material with the aid of the above-described apparatus, and to a metal-based material subjected to large deformation by means of the above-described large deformation method.

The present invention allows large deformation to be applied continuously, safely, efficiently, and productively, yielding materials that possess superplastic characteristics while preserving their initial shape.

DESCRIPTION OF THE INVENTION

Aimed at addressing the above-described problems, the present invention comprises the following technical means.

(1) A large deformation apparatus for metal-based materials, comprising a mold A, a support mechanism B for supporting said mold A, and a rotary mechanism C for rotating said mold A, wherein:

said mold A comprises a mold body 1, four holes 2 that pass through said mold body 1 and intersect in the interior thereof, and engagement means 3*a* for engaging said rotary mechanism C, each of said holes 2 being provided with a punch 5 that can slide or otherwise move with friction in relation to each of said holes 2 and that extends from the end face of said mold body 1 to the intersection of said holes 2;

said support mechanism B comprises restraint plates 6*a*, 6*b*, and 6*c* for restraining the external end faces of the mold body 1 having holes 2, and holding plates 7*a* and 7*b* for holding the mold body 1; and said rotary mechanism C comprises engagement means 3*b* for engaging said engagement means 3*a*, rotary means 8, connection means 9 for connecting said engagement means 3*b* and said rotary means 8.

(2) A large deformation apparatus as defined in (1) above, comprising a pushup mechanism 10 for pushing up the mold A.

(3) A method for applying large deformation to a metal-based material with the aid of a large deformation apparatus as defined in (1) above by combining a large deformation step and a rotational step, wherein:

a large deformation step comprises a step of bending a metal-based work material 11 inside intersecting holes and applying large deformation by pushing in an indenting punch 5 that can be pushed in and that is one of said punches 5, and slidably or frictionally moving an unrestrained punch 5 in the unrestrained state in accordance with the extent to which said indenting punch 5 has been pushed in;

a rotational step comprises a step in which said mold A is rotated 90 degrees by said rotary mechanism C, said indenting punch 5 is restrained and made into a restrained punch 5, said unrestrained punch is made into an indenting punch 5, and one of said restrained punches 5 is made into an unrestrained punch 5; and said large deformation step and rotation step are repeated alternately to repeatedly and continuously perform large deformation.

(4) A metal-based large deformation material, which is subjected to large deformation by a method as defined in (3) above, wherein the crystal particles of the matrix constituting the metal-based material prior to the application of large deformation have a grain size of 100 $\mu$m or greater, and the crystal particles of the matrix constituting the metal-based material subjected to large deformation have a grain size of 10 $\mu$m or less.

(5) A metal-based large deformation material as defined in (4) above, wherein said metal-based material is an aluminum-based alloy, an aluminum-based alloy composite material in which a reinforcement is dispersed, or a titanium alloy.

The present invention will now be described in further detail.

The apparatus of the present invention developed by the inventors in order to address the aforementioned problems is a large deformation apparatus comprising a mold A, a support mechanism B for supporting the mold A, and a rotary mechanism C for rotating the mold A, wherein the mold A comprises a mold body 1, holes 2 that pass through the mold body 1 and intersect in its interior, and engagement means 3*a* for engaging the rotary mechanism C such that each hole 2 is provided with a punch 5 that can slide or otherwise move with friction in relation to the hole 2 and that extends from the end face of the mold body 1 to the intersection of the holes 2;

the support mechanism B comprises restraint plates 6*a*, 6*b*, and 6*c* for restraining the external end faces of the mold body 1 having holes 2, and holding plates 7*a* and 7*b* for holding the mold body 1; and the rotary mechanism C comprises engagement means 3*b* for engaging the engagement means 3*a*, and rotary means 8, and preferably a pushup mechanism 10 for pushing up the mold A.

In addition, the method of the present invention is a method for applying large deformation to materials with the aid of the above-described apparatus by combining a large deformation step and a rotational step, wherein:

the large deformation step comprises a step of bending a metal-based work material 11 inside the intersecting holes and applying large deformation by pushing in an indenting punch 5 that can be pushed in and that is one of the aforementioned punches 5, and slidably or frictionally moving an unrestrained punch 5 in the unrestrained state in accordance with the extent to which the indenting punch has been pushed in;

the rotational step comprises a step of rotating the mold A 90 degrees by the rotary mechanism C, whereby the indenting punch 5 is made into a restrained punch 5, the aforementioned unrestrained punch is made into an indenting punch 5, and one of the aforementioned restrained punches 5 is made into an unrestrained punch 5; and said large deformation step and rotation step are repeated alternately to repeatedly and continuously perform the large deformation.

According to the present large deformation apparatus and large deformation method, the large deformation material 11 inside the apparatus can be subjected to large deformation and bent in the holes intersecting inside the mold body 1 by pushing in the aforementioned indenting punch 5 and slidably or frictionally moving an unrestrained punch 5 in accordance with the extent to which the indenting punch 5 has been pushed in. The indenting punch 5 becomes a restrained punch 5, the unrestrained punch 5 becomes an indenting punch 5, and one of the restrained punches 5 becomes an unrestrained punch 5 as a result of the fact that the indenting punch 5 is pushed in to the same height as the external end face of the mold body 1 having the holes 2, the mold A is then pushed up by the aforementioned pushup mechanism 10 (as shown in FIG. 3), and the mold A is rotated 90 degrees by the rotary mechanism C. In this step, therefore, the punch serving as a new indenting punch 5 can be pushed in, allowing the work material 11 to be continuously subjected to large deformation inside the mold body 1 without being taken out, and the work material 11 to be worked by a continuous large deformation method.

The height of the engagement means 3*a* varies during such rotation because the distance between the center of the mold body 1 and an external end face having a hole 2 is different from the distance between the center of the mold body and an external end face 4 devoid of a hole 2, but the rotary mechanism C can be equipped with a mechanism in which the connection means 9 or the stand for supporting the connection means 9 is provided with a slot, and the connection means 9 or the stand is slid in the vertical direction along this slot, making it possible to smoothly rotate the mold body without encountering any problems.

The mold body 1 can thus be advanced to the next working step merely by being rotated 90 degrees, dispensing with the need to take out the workpiece each time, to reheat the workpiece, or to spend any energy or time for such reheating. Large deformation can thus be applied economically, efficiently, safely, and continuously.

When, for example, an aluminum-based alloy material which had the dendrite structure with a very large crystal grain size (several hundred micrometers) because the material had been manufactured by casting was worked using the present large deformation apparatus and large deformation method, the crystal grain size was reduced to between 5 and 10 $\mu$m after performing only ten cycles at a working temperature of 350 to 450° C. The material was subjected to tensile tests at a temperature of 450° C. and a strain rate of $6\times10^{-4}$ to $1.2\times10^{-2}$, and it was found that the m-value, which is an important indicator of superplastic characteristics, was about 0.2, and the total elongation was about 120%. It was thus learned that even castings that could not be expected to initially have superplasticity because of their dendritic structure could be made into superplasticity-demonstrating materials by using the large deformation apparatus of the present invention to continuously apply large deformation no more than about ten times in accordance with the large deformation method of the present invention.

A preferred example of the present invention will now be described in detail with reference to drawings.

As shown in FIGS. 4 and 5, punches 5 of equal length are inserted into holes 2 that have equal cross-sectional areas and form a cross-shaped through hole 2 in the mold body 1. Of the four holes 2, the punches 5 in contact with the restraint plates 6*a* and 6*b* are restrained, while the other two punches remain in an unrestrained state, with one of the two indenting punches 5 removed.

When a large deformation metal-based material 11 is inserted in this state as a work material into the hole 2 to be plugged by an indenting punch 5, the indenting punch 5 is inserted into this hole 2, and the indenting punch 5 is pressed from above and pushed in, the large deformation material 11 is extruded in the direction of the unrestricted punch 5. In the process, the large deformation material 11 undergoes strong shear deformation in the intersecting hole. The pushing-in of the indenting punch 5 is stopped when the indenting punch 5 has been pushed in to the same height as the external end face of the mold body 1. In the preferred example described below, the restraint plate 6*a* is provided with a pushup mechanism 10 for pushing up the mold A, the mold A is pushed up by the pushup mechanism 10 in the manner shown in FIG. 3, the rotary mechanism C causes the engagement means 3*b* of the rotary mechanism C to engage the engagement means 3*a* of the mold body 1 designed to engage the rotary mechanism C, the mold A is rotated 90 degrees by the rotary mechanism C, the pushup mechanism 10 is retracted, and the mold A is returned to its original position, whereupon the indenting punch 5 and the restrained punch 5 come into contact with the restraint plates 6*b* and 6*a*, respectively, as shown in FIG. 5*c*. The indenting punch 5 assumes an unrestrained state, and the unrestrained punch 5 assumes a state in which it can be pushed in.

A state identical to that in FIG. 5*a* can thus be reproduced merely by changing the condition of each punch in 90-degree increments. By repeating these steps, strong shear deformation can be imparted in a constantly repeating pattern to the large deformation material in required amounts and without any limitations. Another distinctive feature is that shear deformation can be applied highly efficiently because the curving direction can be reversed and large deformation intermittently applied in 180-degree increments to the large deformation material. It is therefore possible to obtain a large deformation material composed of ultrafine crystal grains merely by repeating the above-described procedure the aforementioned required number of times without any limitations being imposed. The procedure is commonly repeated about ten times but no more than about 20 times.

Although the above description was given with reference to rotation in a single direction, it is apparent that an identical effect can be obtained using a mechanism that is a mirror image of the above-described mechanism in terms of arrangement and sequence, and that involves rotating the mold A in the reverse direction in relation to the one described above.

For the sake of convenience, the mold body 1 was described as having an octagonal external shape, but it is more preferable for the external end faces 4 devoid of holes 2 to describe an arc about the aforementioned intersecting holes because in this case the above-described rotation can be performed more smoothly.

As is also shown in FIGS. 6 and 7, selecting a thick disk for the external shape of the mold body 1 dispenses with the need for the above-described pushup mechanism 10 and pushup step, making it possible to achieve large deformation with higher efficiency.

It is apparent in this case that pins 12, wedges, or other stop mechanism should be provided in order to stop the holes at prescribed positions.

Large deformation materials can thus be continuously subjected to large deformation in bulk form without being taken out of the mold or shaped as thin pieces or thin wires. Dynamic or static recovery and recrystallization can therefore be combined, and the crystal grains of the large deformation materials can be reduced in size.

Structural elements of the present invention will now be described in further detail.

Mold Body

The mold material can be selected in a variety of ways in accordance with the service temperature of the material, or the type of work material used. An SKD material, and preferably SKD61, should be used when the work material is a low-melting aluminum-based metal. MDCK is preferred when the work material is a copper alloy or a titanium-based material.

A polygonal cross section was used in order to simplify the external shape of the mold, but the corners of the mold should be removed as much as possible to yield a near-circular shape, as described above.

The cross-sectional shape of the holes may be determined in accordance with the required shape of the finished workpiece. The shape is commonly circular, but may also be quadrilateral or other polygonal as needed.

Punches

Similar to the mold material, the punch material can be selected in a variety of ways in accordance with the service temperature of the material or the type of work material used. An SKD material, and preferably SKD61, should be used when the work material is a low-melting aluminum-based metal. MDCK is preferred when the work material is a copper alloy or a titanium-based material.

The external shape of the punches can be determined in accordance with the required shape of the finished workpiece, and should conform to the shape of the mold.

The shape is commonly circular, but may also be quadrilateral or other polygonal as needed. Depending on the type of work material, the large deformation temperature, and the like, a variety of conditions can be selected for the clearance between the punches and the mold holes.

A clearance of 0.1 to 0.3 $\mu$m is commonly preferred in view of workpiece seizing, biting, and the like.

Support Mechanism

The support mechanism should have some heat resistance because it is commonly exposed together with the mold body to working temperatures.

Rotary Mechanism

The mechanism is not subject to any limitations as long as it can provide 90-degree rotation for the mold body, the work material, and the punches.

A preferred example of such a mechanism is one in which a hexagonal protrusion (head of a hexagonal bolt) is provided near the center of rotation of the mold body 1. The mechanism also comprises a hexagonal wrench that fits onto this protrusion, and a stand for supporting the wrench. The stand is also provided with a sliding mechanism for ensuring vertical movement of the engagement means 3*b*, rotary means 8, and connection means 9.

Large Deformation Metal-Based Material

The large deformation work material used in accordance with the present invention is not subject to any substantial limitations in terms of its properties as long as it is a plastically deformable material, but is preferably a relatively low-melting nonferrous metal material casting or a nonferrous metal material composite that contains dispersed high-hardness particles and that is not amenable to aftertreatment. The large deformation of the present invention can be applied, for example, to magnesium-based alloys, magnesium-based alloys containing dispersed reinforcing particles or whiskers, aluminum-based alloys, aluminum-based alloy composite materials containing dispersed reinforcing particles or whiskers, titanium-based alloys, and copper alloys.

Figure 1:
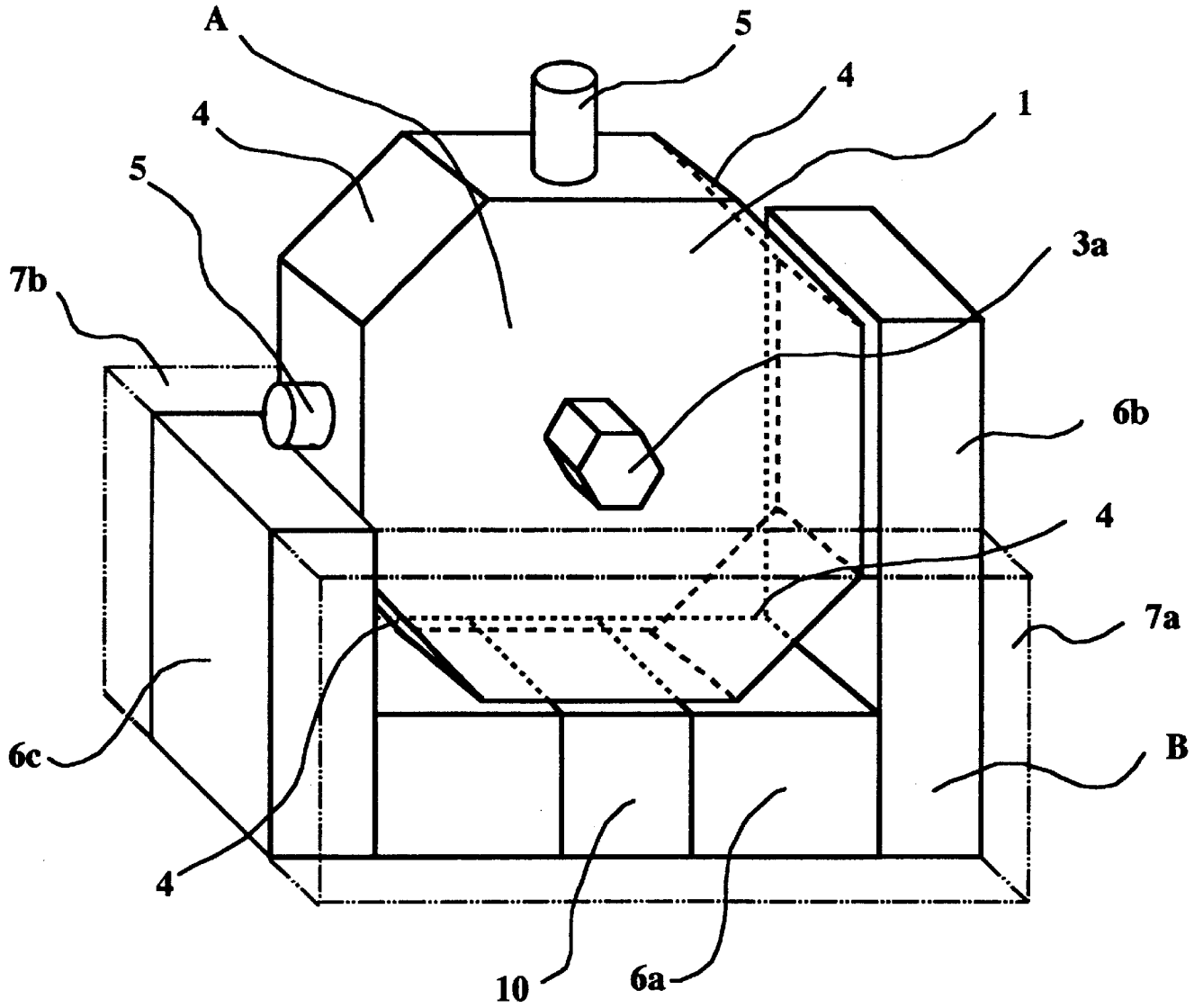
FIG. 1 is an external view of the large deformation apparatus, with the holding plates and the rotary mechanism C removed.
Figure 2:
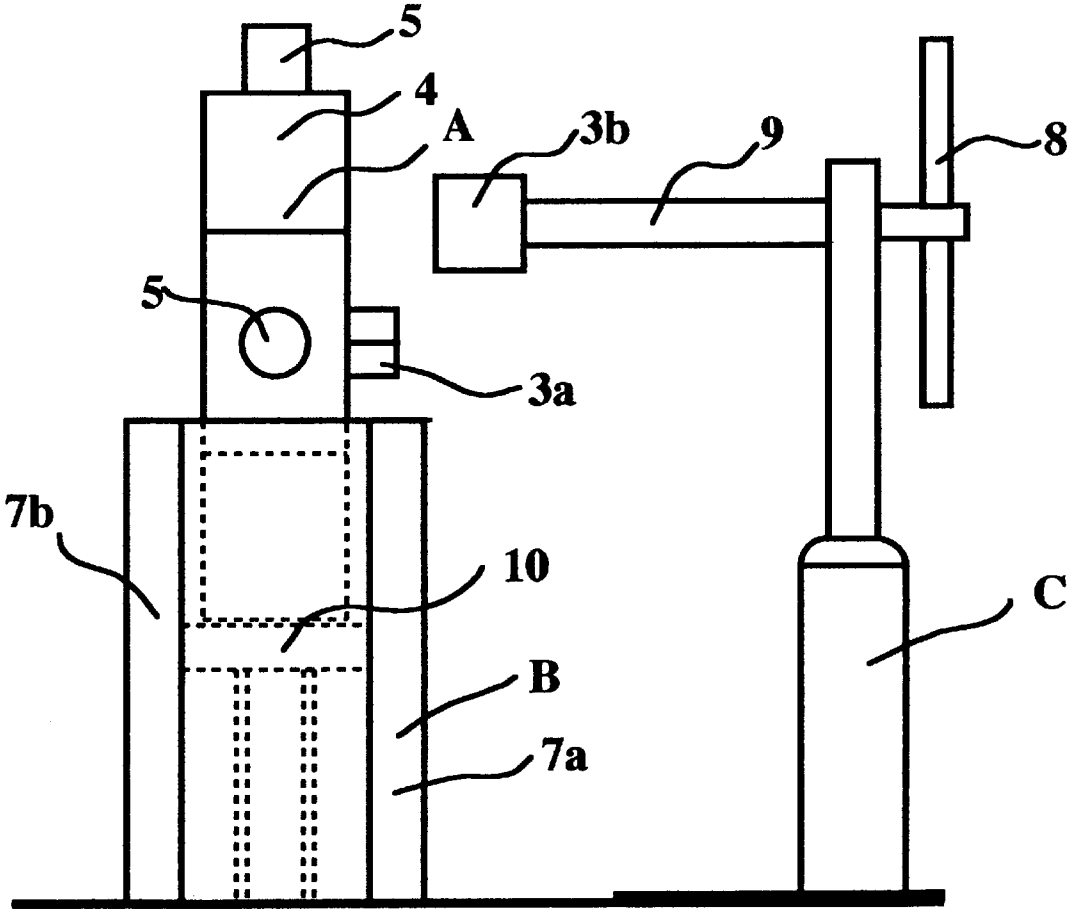
FIG. 2 is a side view of the large deformation apparatus.
Figure 3:
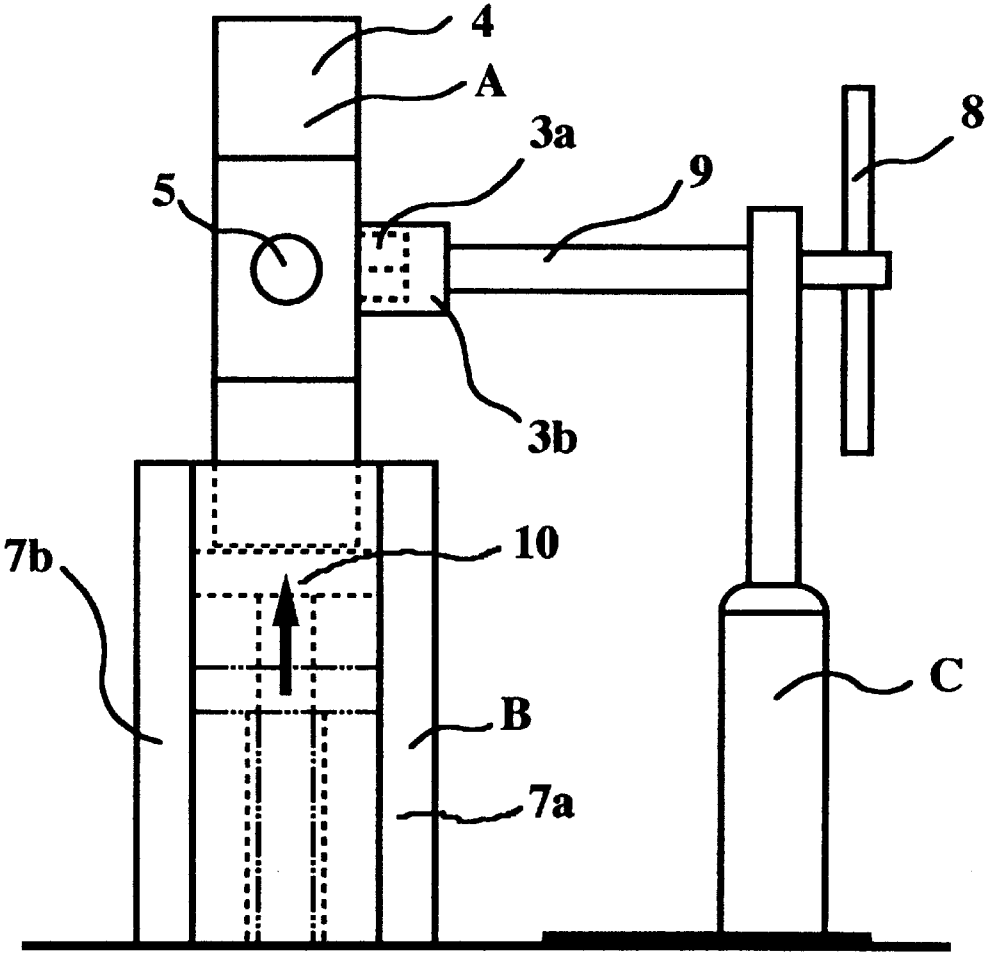
FIG. 3 is a side view of the large deformation apparatus in a state in which the mold A can be rotated while pushed up by a pushup mechanism 10.
Figure 4:
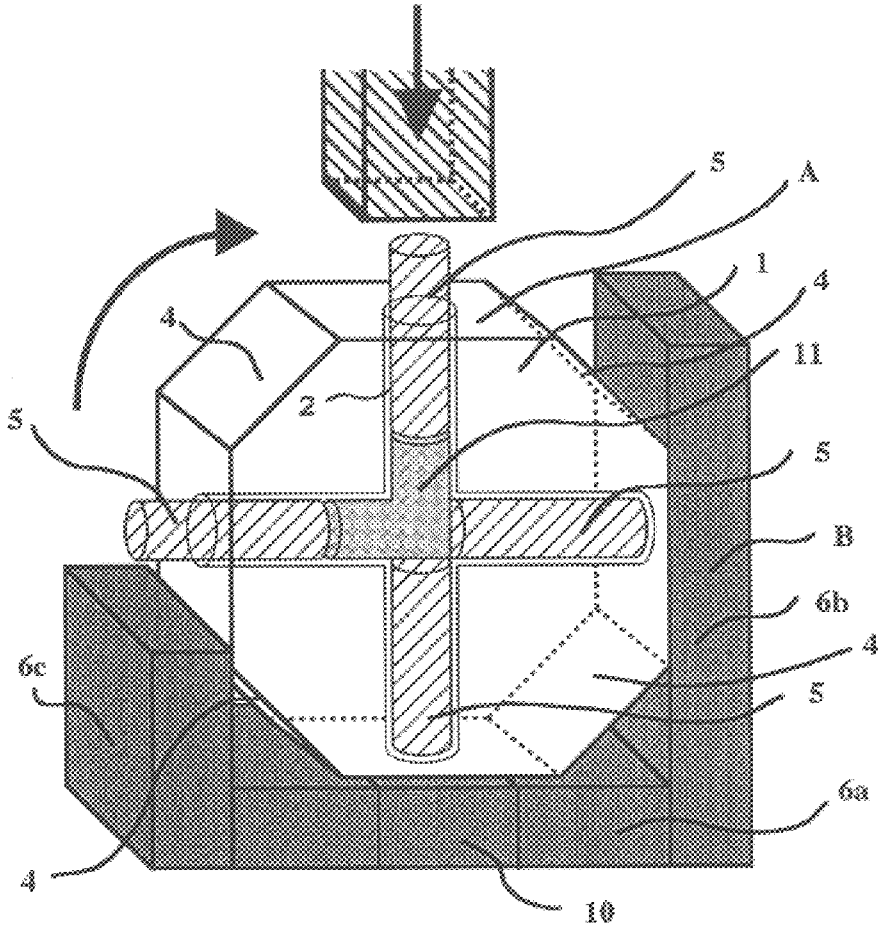
FIG. 4 is an external view of the large deformation apparatus in a state in which the holes in the mold body, the metal material subjected to large deformation, and the punch are depicted, with the holding plates and the rotary mechanism C removed.
Figure 5:
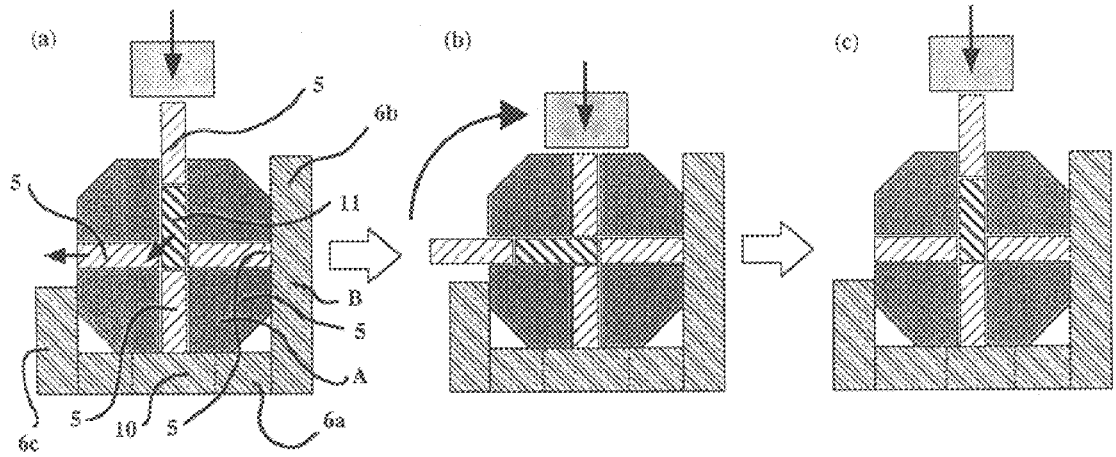
FIG. 5 is a cross section schematically depicting the large deformation steps.
Figure 6:
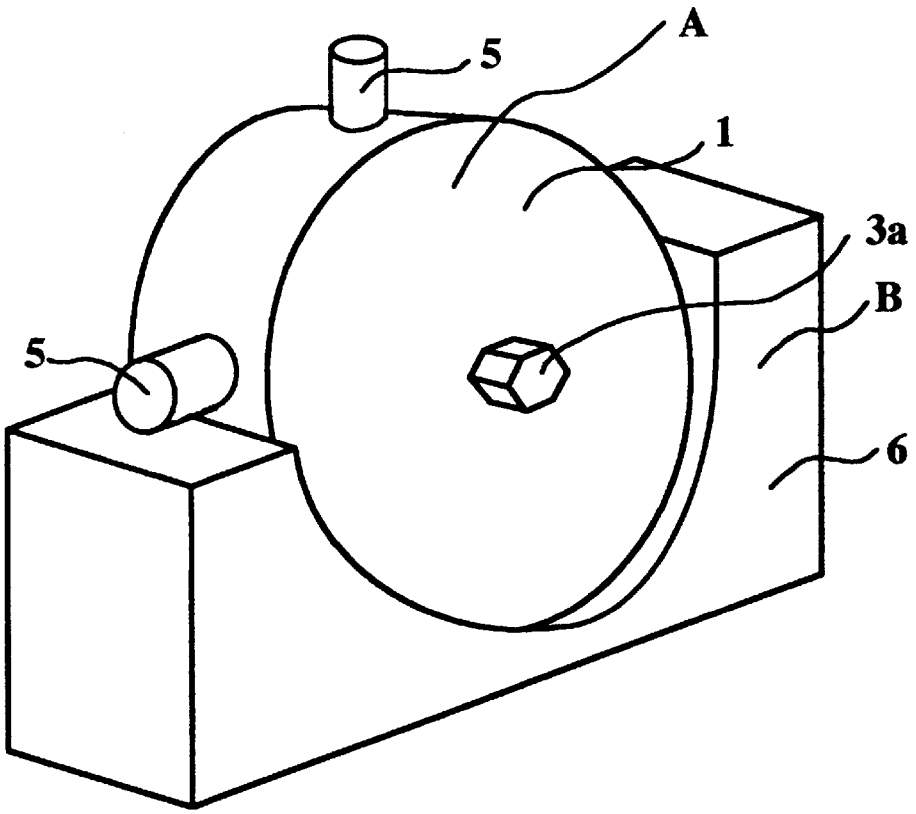
FIG. 6 is an external view depicting, as a modification of the large deformation apparatus, a mold body shaped as a thick disk, with the holding plates and the rotary mechanism C removed.
Figure 7:
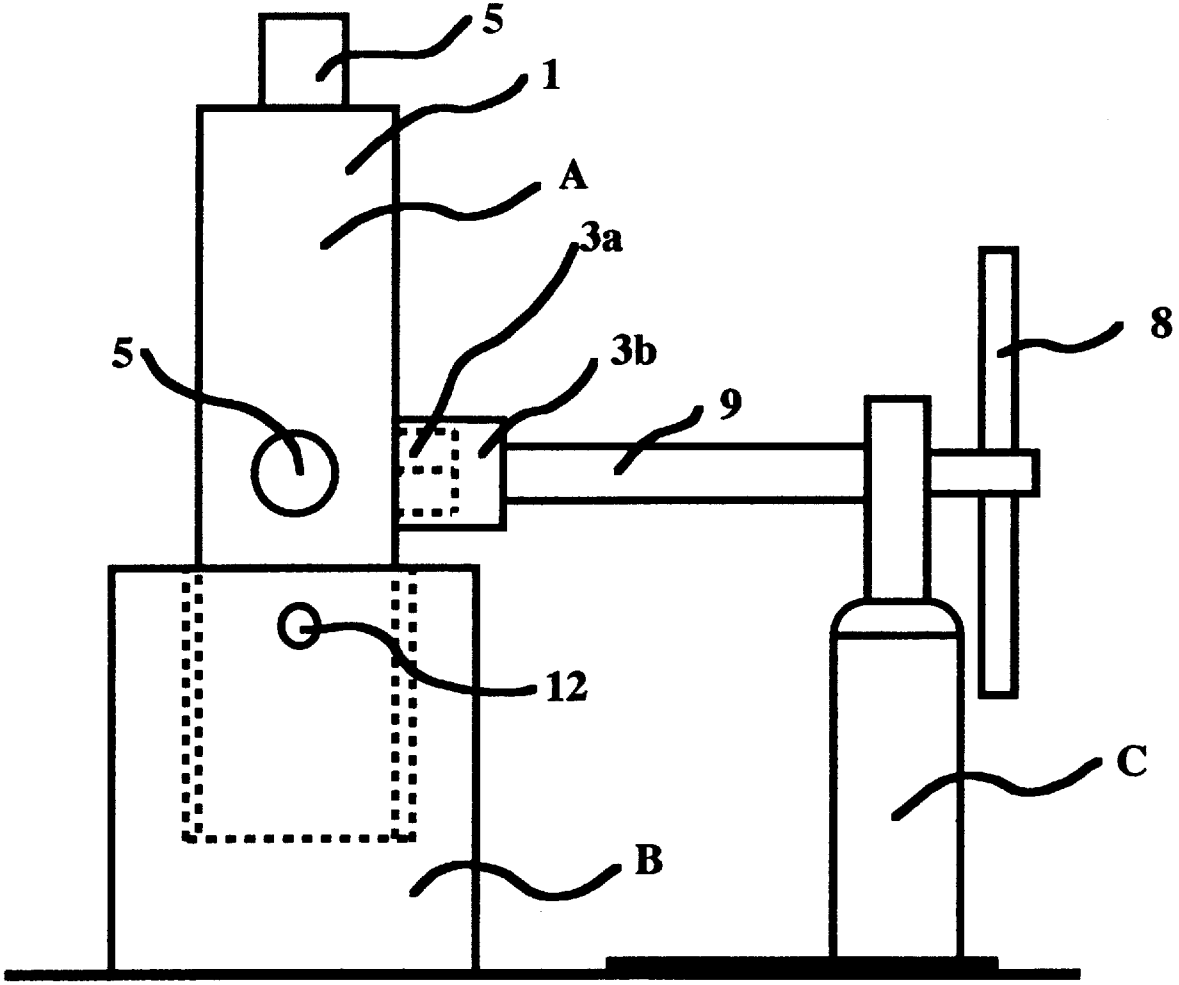
FIG. 7 is a side view of a large deformation apparatus whose mold body is shaped as a thick disk.

In the drawings, A is a mold, B is a support mechanism, C is a rotary mechanism, 1 is a mold body, 2 is a hole, 3*a* and 3*b* are engagement means, 4 is an external end face without the holes 2, 5 is a punch, 6 is a restraint plate, 7 is a holding plate, 8 is rotary means, 9 is connection means, 10 is a pushup mechanism, 11 is a metal-based large deformation material, and 12 is a rotation-stopping pin.

DESCRIPTION OF THE PREFERRED EMBODIMENTS

EXAMPLE 1

The present invention will now be described in detail on the basis of working examples, but these working examples merely represent preferred examples of the present invention, and the present invention is in no way limited by these working examples.

An AC4C alloy was used as the work material, this was worked using a lathe to a cylindrical shape having a diameter of 20 mm and a length of 40 mm, and the external surface thereof was coated with a graphite lubricant to facilitate extrusion.

Figure 8:
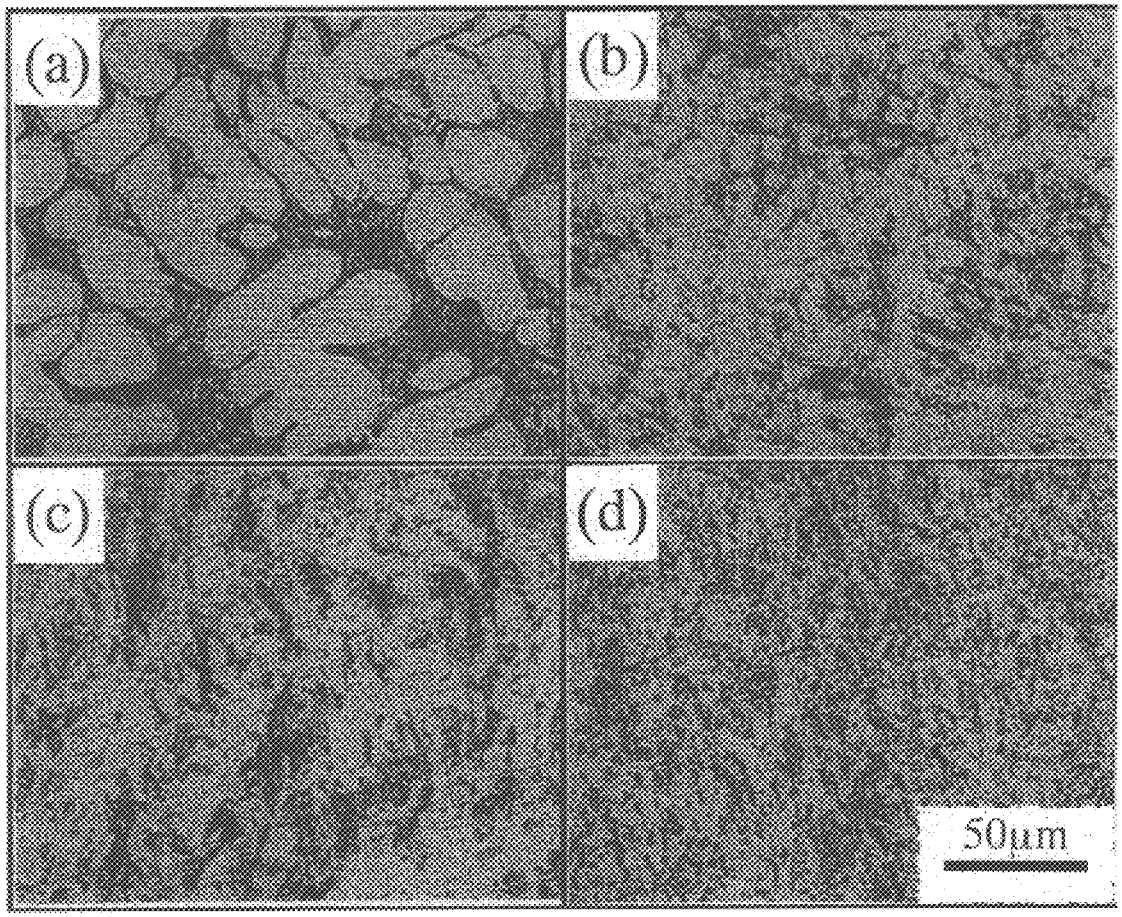
FIG. 8 is a photomicrograph in lieu of drawing depicting the microstructure of a metal material before and after being subjected to large deformation ((a): before large deformation, (b): after six cycles of large deformation, (c): after ten cycles of large deformation, (d): after 20 cycles of large deformation).

The working temperature was set to 623K, 673K, and 723K, and the number of work cycles was set to 6, 10, and 20. As shown in the photomicrograph in lieu of drawing in FIG. 8, the crystal grain size thereof was about 100 $\mu$m, 50 $\mu$m, and 5 $\mu$m, respectively. Tests were also conducted at variable elastic stress rate in order to measure plastic characteristics at high temperatures. As a result, the m-value, which is a strain rate susceptibility index, was found to be 0.21, as shown in Table 1. In other words, near-superplastic characteristics were obtained. By contrast, mere 25% total elongation was obtained as a result of similar tensile tests in which the same starting material was used, but this material was not subjected to the deformation applied by the large deformation apparatus of the present invention.

TABLE 1

| Strain rate (1/s) | Elongation (%) |
|---|---|
| $6 \times 10^{-4}$ | 111 |
| $2.5 \times 10^{-3}$ | 79 |
| $6 \times 10^{-3}$ | 126 |
| $1.2 \times 10^{-2}$ | 96 |

EXAMPLE 2

Aluminum alloy composite material 2024 in which 27% silicon nitride whiskers were dispersed for reinforcement purposes was used as the work material. Large deformation was imparted under the same conditions as in Working Example 1, and high-temperature tensile tests were performed at 460 to 540° C. The elongation shown in Table 2 was obtained, and the m-value was 0.34, indicating that superplasticity had been achieved. By contrast, mere 2% and 10% total elongations were obtained at room temperature and 450° C., respectively, as a result of similar tensile tests in which the same starting material was used, but this material was not subjected to the deformation applied by the large deformation apparatus of the present invention.

TABLE 2

| Strain rate (1/s) | Elongation (%) |
|---|---|
| $4 \times 10^{-2}$ | 100 |
| $1 \times 10^{-1}$ | 130 |
| $2 \times 10^{-1}$ | 148 |
| $4 \times 10^{-1}$ | 149 |
| $9 \times 10^{-1}$ | 125 |

EXAMPLE 3

Titanium allay Ti-6Al-4V was used as the work material. When large deformation was applied five times at 650° C. in a manner similar to Working Example 1, the average grain diameter could be reduced to about 3 $\mu$m, yielding superplasticity.

Thus, the large deformation apparatus of the present invention allows large deformation to be applied continuously, safely, efficiently, and productively to conventional materials devoid of superplastic characteristics, yielding materials that possess superplastic characteristics while preserving their initial shape.

Whereas in conventional practice it is very difficult to provide castings with excellent superplastic characteristics or to sacrifice efficiency in achieving such characteristics, the large deformation apparatus of the present invention is very advantageous commercially because it allows large deformation to be applied efficiently, productively, and safely.

What is claimed is:

1. A large deformation apparatus for metal-based materials, comprising a mold (A), a support mechanism (B) for supporting said mold (A), and a rotary mechanism (C) for rotating said mold (A), wherein:

said mold (A) comprises a mold body (1), four holes (2) that pass through said mold body (1) and intersect in the interior thereof, and engagement means (3*a*) for engaging said rotary mechanism (C), each of said holes (2) being provided with a punch (5) that slides or moves with friction in relation to each of said holes (2) and that extends from an end face of said mold body (1) to the intersection of said holes (2);

said support mechanism (B) comprises restraint plates (6*a*), (6*b*), and (6*c*) for restraining an external end faces of the mold body (1) having holes (2), and holding plates (7*a*) and (7*b*)) for holding the mold body (1): and said rotary mechanism (C) comprises engagement means (3*b*) for engaging said engagement means (3*a*), rotary means (8) and connection means (9) for connecting said engagement means (3*b*) and said rotary means (8).

2. A large deformation apparatus as defined in claim 1, comprising a pushup mechanism (10) for pushing up the mold (A).

3. A method for applying large deformation to a metal-based material with the aid of a large deformation apparatus as defined in claim 1 above by combining a large deformation step and a rotational step, wherein:

a large deformation step comprises a step of bending a metal-based work material (11) inside intersecting holes and applying large deformation by pushing in an indenting punch (5) that is one of said punches (5), and slidably or frictionally moving an unrestrained punch (5) in an unrestrained state in accordance with an extent to which said indenting punch (5) has been pushed in;

a rotational step comprises a step in which said mold (A) is rotated 90 degrees by said rotary mechanism (C), said indenting punch (5) is restrained and made into an indenting punch (5), and one of said restrained punches (5) is made into an unrestrained punch (5); and said large deformation step and rotation step are repeated alternately to repeatedly and continuously perform large deformations.

4. A metal-based large deformation material, which is subjected to large deformation by a method as defined in claim 3, wherein the crystal particles of the matrix constituting the metal-based material prior to the application of large deformation have a grain size of 100 $\mu$m or greater, and the crystal particles of the matrix constituting the metal-based material subjected to large deformation have a grain size of 10 $\mu$m or less.

5. A metal-based large deformation material as defined in claim 4, wherein said metal-based material is an aluminum-based alloy, an aluminum-based alloy composite material in which a reinforcement is dispersed, or a titanium alloy.

* * * * *